US007353683B2

(12) United States Patent
Bogart

(10) Patent No.: US 7,353,683 B2
(45) Date of Patent: Apr. 8, 2008

(54) SURGICAL NEEDLE MANUFACTURING PROCESS

(75) Inventor: Michael W. Bogart, Milford, CT (US)

(73) Assignee: Tyco Healthcare Group LP, Norwalk, CT (US)

( * ) Notice: Subject to any disclaimer, the term of this patent is extended or adjusted under 35 U.S.C. 154(b) by 211 days.

(21) Appl. No.: 11/048,354

(22) Filed: Feb. 1, 2005

(65) Prior Publication Data

US 2005/0183486 A1 Aug. 25, 2005

Related U.S. Application Data

(60) Provisional application No. 60/546,129, filed on Feb. 20, 2004.

(51) Int. Cl.
*B21D 28/00* (2006.01)
*A61B 17/06* (2006.01)
*B21G 1/12* (2006.01)

(52) U.S. Cl. ..... 72/341; 163/5; 606/223

(58) Field of Classification Search ..... 72/341, 72/340, 377; 29/558; 163/1, 5; 606/223
See application file for complete search history.

(56) References Cited

U.S. PATENT DOCUMENTS 3,038,475 A * 6/1962 Orcutt ..... 606/223
4,587,202 A 5/1986 Borysko
4,660,559 A 4/1987 McGregor et al.
4,672,734 A 6/1987 Kawada et al.
4,777,096 A 10/1988 Borysko
4,785,868 A 11/1988 Koenig, Jr.
4,799,484 A 1/1989 Smith et al.
4,805,292 A 2/1989 Noguchi
4,932,961 A 6/1990 Wong et al.
4,959,068 A 9/1990 Bendel et al.
4,968,362 A 11/1990 Prasad
5,002,564 A 3/1991 McGregor et al.
5,002,565 A 3/1991 McGregor
5,030,228 A 7/1991 Wong et al.
5,057,401 A 10/1991 Borysko et al.
5,100,432 A 3/1992 Matsutani
5,123,910 A 6/1992 McIntosh
5,155,943 A 10/1992 Matsutani et al.
5,178,628 A 1/1993 Otsuka et al.
5,258,013 A 11/1993 Granger et al.

(Continued)

FOREIGN PATENT DOCUMENTS

EP 0 650 698 A1 5/1995

(Continued)

OTHER PUBLICATIONS

Copy of International Search Report for EP 07 00 3237.0, dated Jun. 1, 2007.

*Primary Examiner*—Daniel C. Crane

(57) ABSTRACT

A process for manufacturing a surgical needle incorporates at least one pressing operation which, preferably, in conjunction with a trimming and/or etching process, ultimately forms the sharpened needle end. The grinding operation in the preferred process does not produce the primary sharpened edges of the needle, but, rather is incorporated, in one instance, to reduce excess needle material prior to the pressing operation. Consequently, the amount of flash material generated during pressing is substantially reduced. This feature desirably enhances the subsequent trimming and etching operations, and produces a needle which is extremely sharp, durable and exhibits an improved retention of sharpness over periods of prolonged use.

19 Claims, 6 Drawing Sheets

U.S. PATENT DOCUMENTS 5,263,974 A 11/1993 Matsutani et al.
5,330,441 A 7/1994 Prasad et al.
5,342,397 A 8/1994 Guido
5,411,613 A 5/1995 Rizk et al.
5,464,422 A 11/1995 Silverman
5,476,480 A 12/1995 Matsutani et al.
5,477,604 A 12/1995 Smith et al.
5,533,982 A 7/1996 Rizk et al.
5,539,973 A 7/1996 Smith et al.
5,626,043 A 5/1997 Bogart et al.
5,630,268 A 5/1997 Smith et al.
5,644,834 A 7/1997 Smith et al.
5,649,961 A 7/1997 McGregor et al.
5,661,893 A 9/1997 Smith et al.
5,683,416 A 11/1997 McGregor et al.
5,693,454 A 12/1997 Munoz
5,730,732 A 3/1998 Sardelis et al.
5,749,897 A 5/1998 Matsutani et al.
5,762,811 A 6/1998 Munoz
5,776,268 A 7/1998 McJames et al.
5,783,001 A 7/1998 Sardelis et al.
5,797,961 A 8/1998 Smith et al.
5,814,166 A 9/1998 Ackerman et al.
5,853,423 A 12/1998 McGregor et al.
5,913,875 A 6/1999 Smith et al.
6,018,860 A 2/2000 Smith et al.
6,214,030 B1 4/2001 Matsutani et al.
6,322,581 B1 11/2001 Fukuda et al.
6,497,994 B1 12/2002 Kafrawy
2004/0106948 A1* 6/2004 Cunningham ..... 606/223

FOREIGN PATENT DOCUMENTS

EP 1 506 743 A1 2/2005

* cited by examiner

SURGICAL NEEDLE MANUFACTURING PROCESS

CROSS REFERENCE TO RELATED APPLICATIONS

The present application claims priority of U.S. Provisional Patent Application Ser. No. 60/546,129, filed on Feb. 20, 2004. The priority of this prior application is expressly claimed and the disclosure of which are hereby incorporated by reference in its entirety

BACKGROUND

Background of Related Art

Suturing needles for applying sutures, or stitches, by hand in cutaneous and subcutaneous tissue are well known in the art. The suturing needles are typically used to close wounds or adjoin adjacent tissue, often at the conclusion of a surgical procedure. Suturing needles are usually made from a cut blank of material such as stainless steel. The cut blank is metal-worked using well known machining techniques to form the suturing needle. The needle generally includes a shaft, a rear end portion with an aperture or channel to secure a suture thread and a needle head at a front end portion for puncturing skin and for passing through tissue. The needle head typically incorporates a sharpened needle tip at its distal end and cutting edges. Alternatively, the needle tip may be of a tapered configuration. Straight and curved needles including multiple curved configurations are also known the art.

Conventional methods for needle manufacture include subjecting a needle blank to a series of grinding operations to form the desired needle edges and needle point. However, the grinding operations are often operator dependent thereby increasing the potential for needle defects. In addition, sharpened needle edges formed via conventional operations fail to retain their sharpness over extended use.

SUMMARY

Accordingly, the present disclosure is directed to a process for manufacturing a surgical needle and a surgical needle thereby produced. The preferred process incorporates at least one pressing operation which, preferably, in conjunction with a trimming and/or etching process, ultimately forms the sharpened needle end. The grinding operation in the preferred process does not produce the primary sharpened edges of the needle, but, rather is incorporated, in one instance, to reduce excess needle material prior to the pressing operation. Consequently, the amount of flash material generated during pressing is substantially reduced. This feature desirably enhances the subsequent trimming and etching operations, and produces a needle which is extremely sharp, durable and exhibits an improved retention of sharpness over periods of prolonged use.

In one preferred embodiment, the process for manufacturing a surgical needle includes the steps of providing a surgical needle blank of biocompatible material, removing needle material (e.g., through a grinding process) from a peripheral portion of one end of the needle blank to define a needle end having a reduced cross-sectional dimension, pressing the needle end to form at least three intersecting surfaces on the needle end and forming cutting edges adjacent areas of intersection of the at least three surfaces to define a plurality of cutting edges on the needle end. The process may also include the step of coining the needle blank prior to grinding to define a needle end having first, second and third sides. Preferably, the second and third sides are subjected to a grinding process to remove material adjacent the respective sides.

In a preferred embodiment, the step of pressing includes form pressing the first, second and third sides to produce the at least three surfaces of the needle end. A die mechanism having a die arrangement with a die concavity therein may be provided. The die concavity defines a tapered characteristic whereby the cross-sectioned area occupied by the concavity decreases from one end of the concavity to the other end of the concavity. The needle end is positioned within the die concavity to impart a tapered configuration to the needle end. Preferably, the die cavity of the die mechanism defines a general triangular configuration having first and second pressing surfaces. The needle blank is positioned within the concavity of the die mechanism to impart a generally triangular-shaped cross-section to the needle end. The die mechanism may include a die punch positioned in opposition of the die concavity. The die punch engages the first surface of the needle end upon relative movement of the die punch and the die mechanism. The die punch may have a radiused surface to impart an arcurate surface on the first surface of the needle end.

Excess needle flash material may be created adjacent areas of intersection of the first and second surfaces, and the first and third surfaces of the needle end during the pressing step. This excess flash material is removed through a trimming operation. The trimming step or trimming operation preferably includes forming a crease line along the areas of intersection of the first and second sides, and the first and third sides of the needle end. The needle blank may then be subjected to an etching process to remove excess flash material and/or sharpen the cutting edges. Heat treating the needle blank is also preferable.

BRIEF DESCRIPTION OF THE DRAWINGS

The accompanying drawings, which are incorporated in and constitute a part of this specification, illustrate embodiments of the disclosure and, together with a general description of the disclosure given above, and the detailed description of the embodiment(s) given below, serve to explain the principles of the disclosure, wherein.

Figure 1:
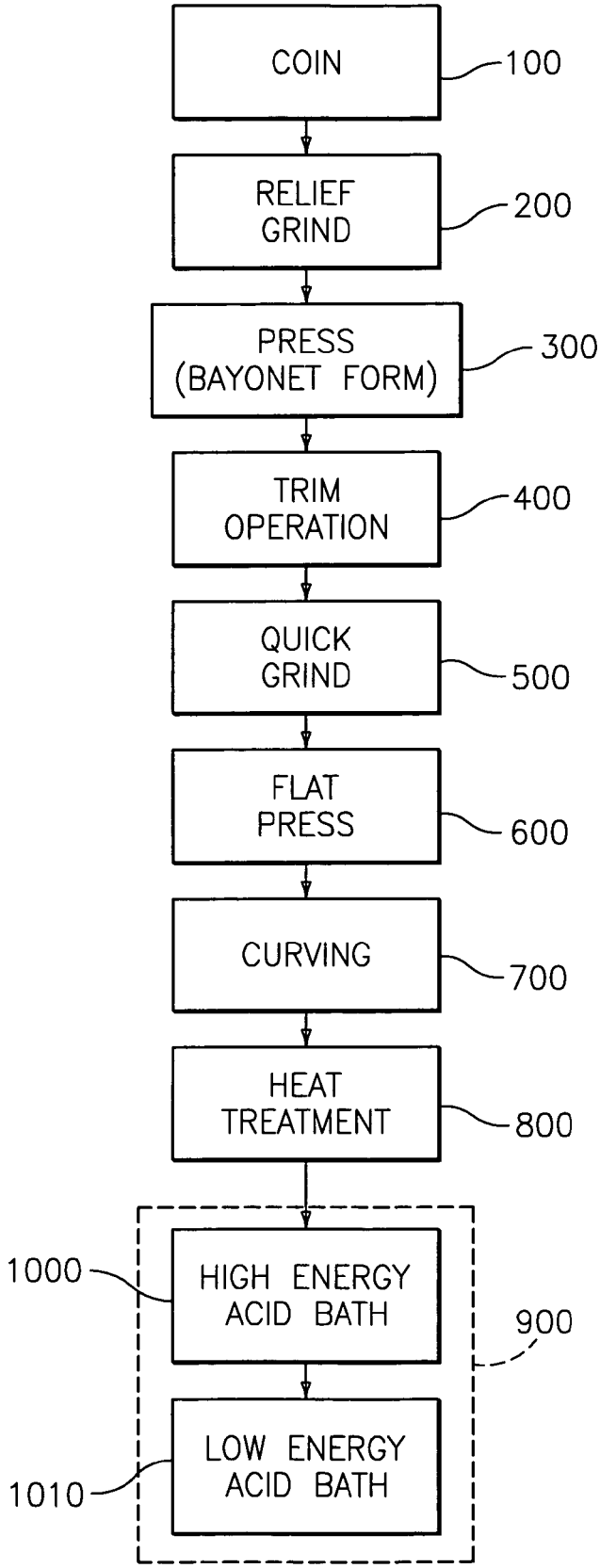
FIG. 1 is a block diagram of a preferred embodiment of a process of manufacturing a surgical needle in accordance with the principles of the present disclosure.
Figure 4A:
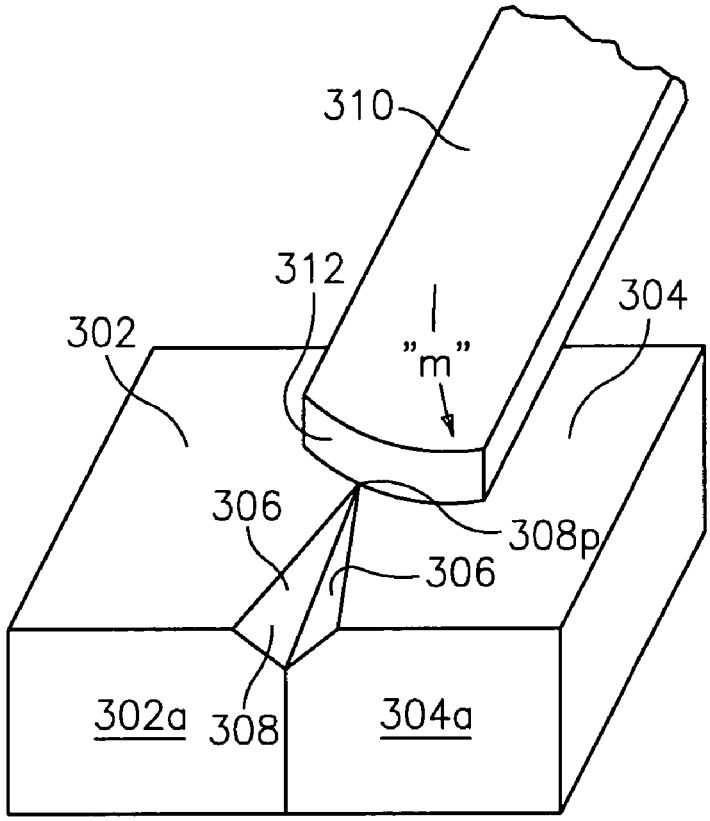
Figure 4B:
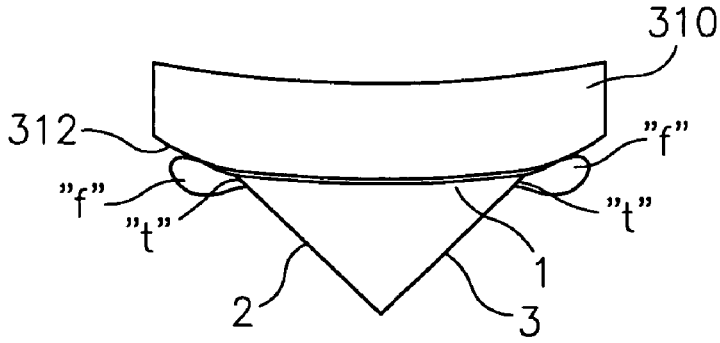
Figure 5A:
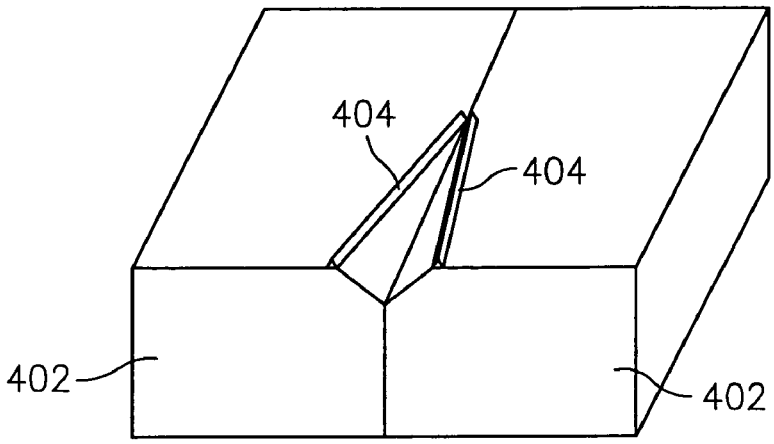
Figure 5B:
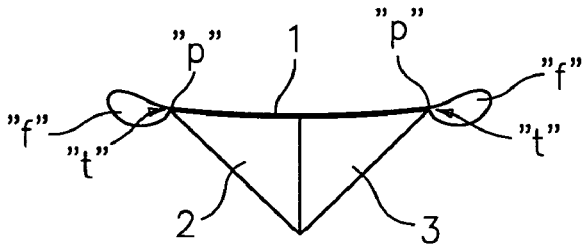
Figure 6:
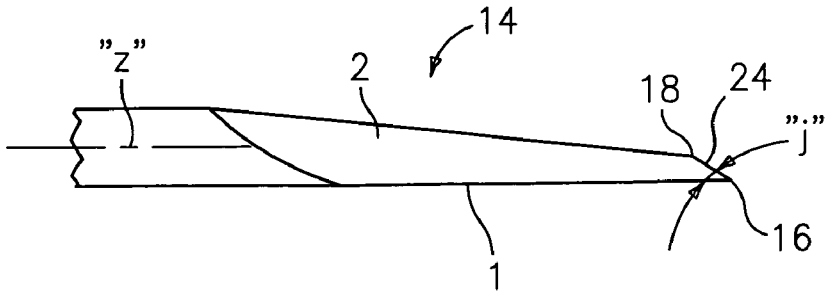
Figure 7A:
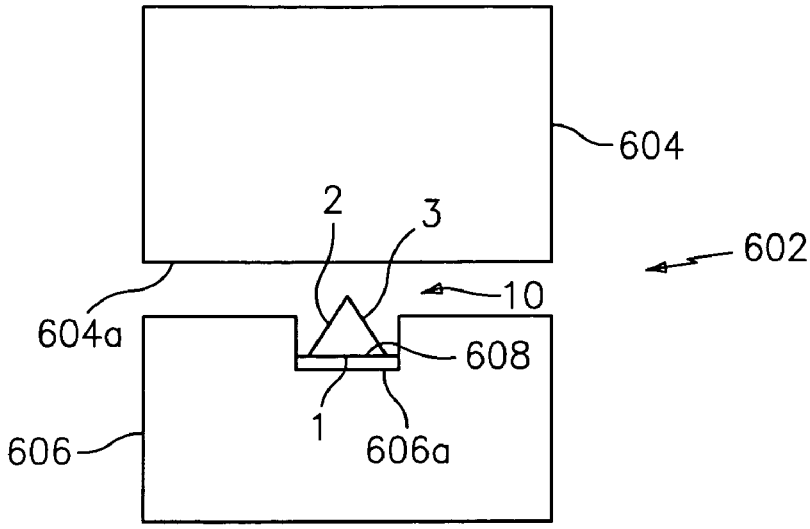
Figure 7B:
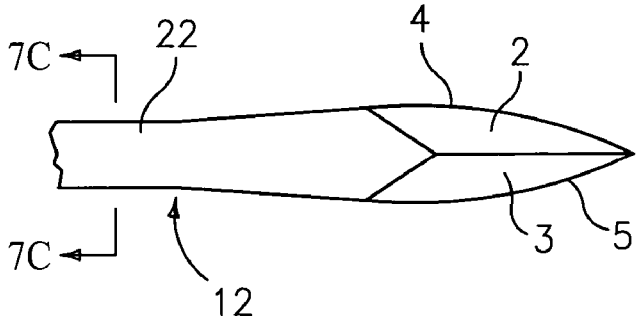
Figure 7C:
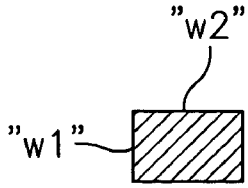

FIG: 3D is an axial end view of the needle blank subsequent to the relief grind operation;

FIG. 4A is a plan view of the bayonet die configuration used in the press operation of the process of FIG. 1;

FIG. 4B is a cross sectional view of the needle end engaged by the upper press during the press operation;

FIG. 5A is a perspective view of the lower dies used in the trim operation of the process of FIG. 1;

FIG. 5B is an end axial view of the needle end subsequent to the trim operation;

FIG. 6 is a side plan view of the needle end subsequent to the quick grind operation of the process of FIG. 1;

FIG. 7A is a side view of a pair of dies utilized in the flat press operation of the process of FIG. 1;

FIG. 7B is a top plan view of the needle end subsequent to the flat press operation; and FIG. 7C is a cross-sectional view taken along lines 7C-7C of FIG. 7B illustrating the configuration of the main body of the needle.

DESCRIPTION OF PREFERRED EMBODIMENTS

Preferred embodiments(s) of the process for manufacturing a surgical needle of the present disclosure will now be described in detail with reference to the drawings wherein like reference numerals identify similar or like elements throughout the several views.

Referring now to the block diagram of FIG. 1, there is illustrated a preferred process for needle manufacture in accordance with the principles of the present disclosure. A needle blank in the form of a cylindrical rod having a desired or predetermined length is provided. The needle blank is to be eventually formed into a surgical needle. The needle blank may be cut from suitable biocompatible needle stock, including stainless steel, titanium or titanium alloys. The needle blank also preferably has a drilled recess (e.g., through laser drilling) in one end for receiving a surgical suture to attach the suture to the needle. It is also contemplated that the needle blank may have an open channel, an eye, etc. for receiving and attaching the suture as is known in the art.

Figure 2A:
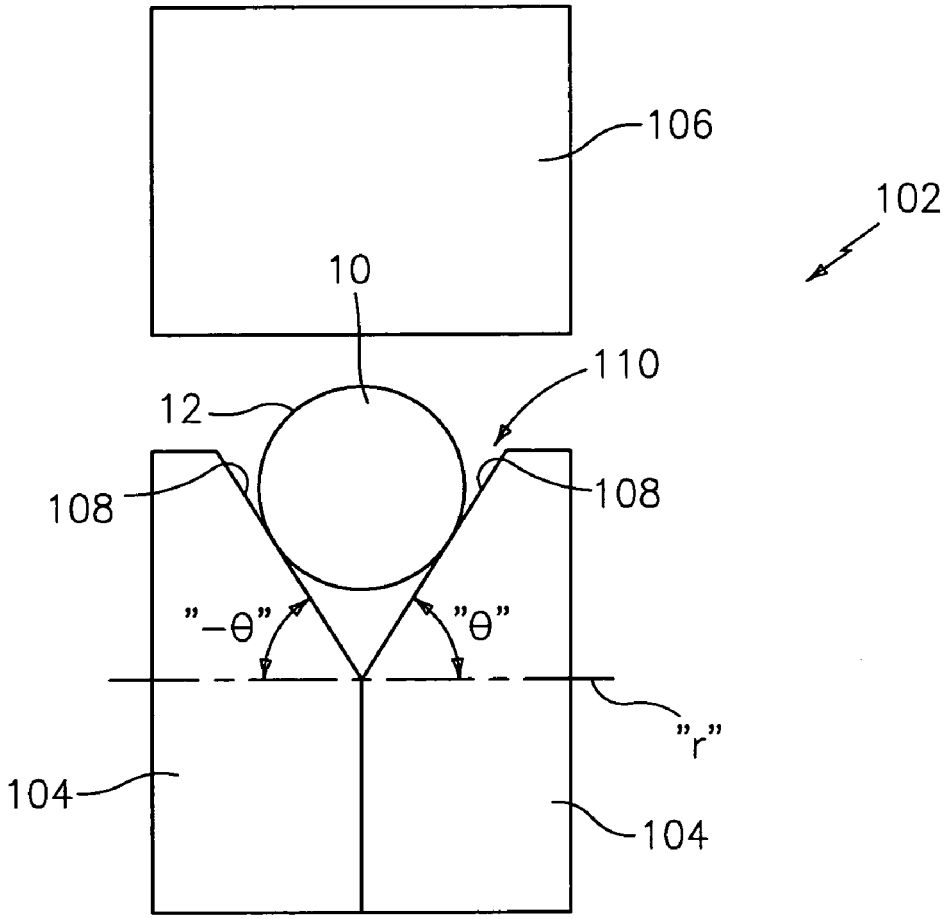
FIG. 2A is a plan view of the coining dies utilized in the coining operation of the process of FIG. 1.

With reference to FIGS. 1 and 2A, the first step in the preferred process is a coining operation 100. The coining operation imparts a desired cross-sectional configuration to needle blank 10. The needle blank 10 is preferably placed within a collet (not shown in FIG. 2A). Any conventional collet adapted to secure a needle blank in fixed relation may be utilized. The collet may be indexed to determine and/or control orientation of the needle blank 10 relative to a collet holder employed in the remaining operative steps. The collet and needle blank 10 are mounted in relation to a die mechanism 102 of the coining operation. In one embodiment, the collet may be mounted within a collet holder (not shown) of the die mechanism.

The preferred die mechanism 102 includes two lower dies 104 and a planar upper die 106. Lower dies 104 incorporate inclined swaging or coining surfaces 108 which extend at respective angles θ,−θ relative to transverse axis "r" of the dies 104. Coining surfaces 108 define a concavity or recess 110 within lower dies 104. Angles θ,−θ may be any oblique angle. Preferably, angles θ,−θ have an absolute value ranging from about 40° to about 70° relative to axis "r". In one preferred embodiment, the absolute value of angles θ,−θ is about 58°. Other angular orientations are also envisioned. Dies 104, 106 are preferably formed of a carbide material although other materials are envisioned as well.

Figure 2B:
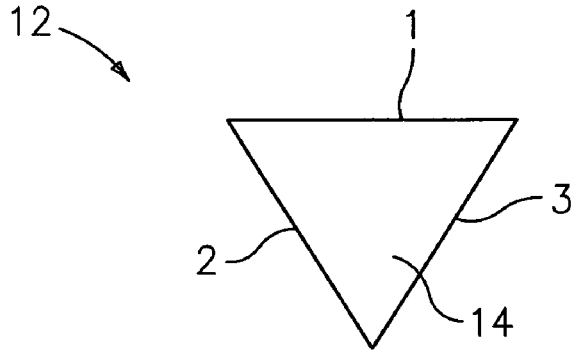
FIG. 2B is an axial view of the needle end subsequent to the coining operation.

Needle blank 10 is positioned within concavity 110. The die mechanism is actuated to advance upper die 106 toward lower dies 104 to swage or coin at least the needle end 12. This coining operation 100 imparts a generally triangular shaped cross-section to the needle end 10. FIG. 2B illustrates in axial view the configuration of the needle end 12 of the needle blank 10 subsequent to the coining operation. As appreciated, the end surface 14 of needle end 12 is substantially planar or flat. The three sides of needle end 12, namely sides 1, 2 and 3, generally define an equilateral triangle. For reference purposes, side 1 of needle end 12 is the surface directly engaged by upper die 106 and sides 2, 3 are the surfaces contacted by coining surfaces 108 of lower dies 104.

Figure 3A:
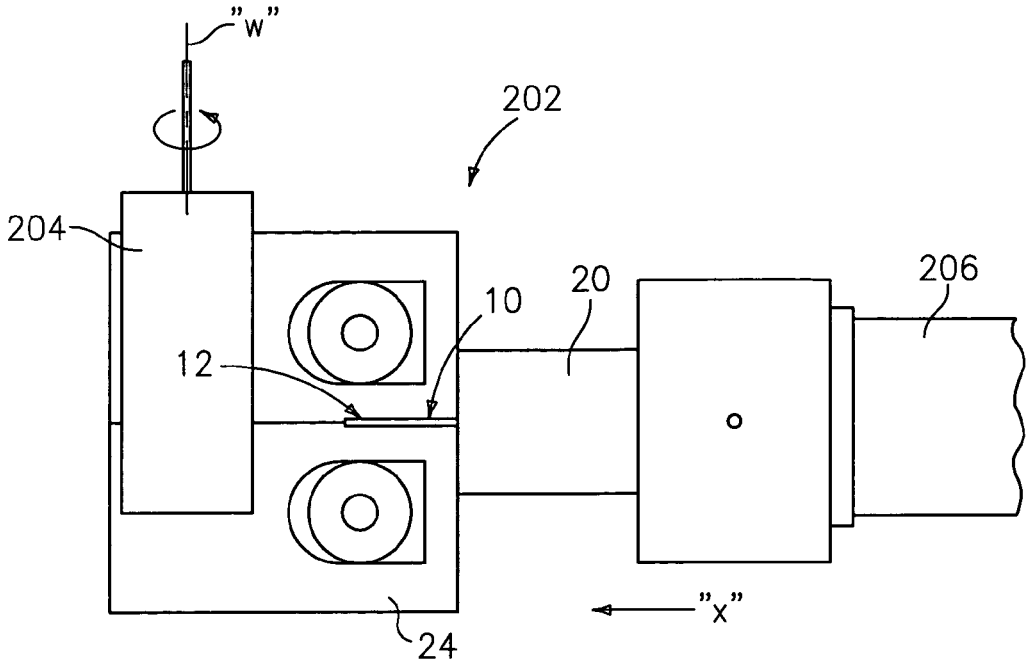
FIG. 3A is a top schematic view of the relief grind mechanism used in the relief grind operation of the process of FIG. 1.
Figure 3B:
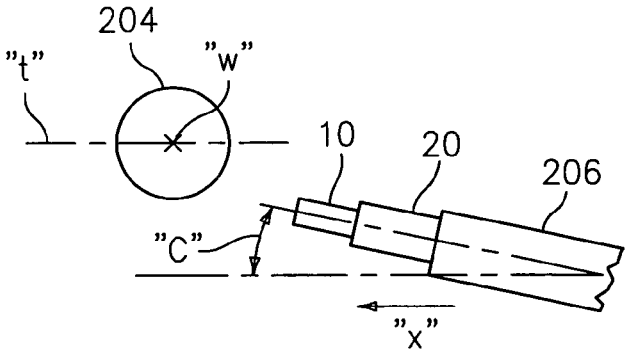
FIG. 3B is a side schematic view illustrating the arrangement of the collet and collet holder relative to the grind wheel of the relief grind mechanism.

With reference again to FIG. 1, the next step in the process is a relief grind operation 200. The relief grind operation removes excess material from needle end 12 and, optionally, may provide a preliminary pointed configuration to the needle end 12. The removal of needle material from needle end 12 greatly facilitates the subsequent pressing (e.g., bayonet forming), trimming and/or acid etching operations of the process. As best depicted in the top schematic view of FIG. 3A, the relief grind mechanism 202 of the relief grind operation 200 includes grind wheel 204. Grind wheel 204 is adapted to rotate about rotational axis "w". Collet holder 206 secures collet 20 at a predetermined rotational or angular orientation relative to the axis of the collet holder 206 to selectively present any of the sides 1, 2, 3 to grind wheel 202. The rotational or angular orientation may be determined by the indexing on the external surface of collet 20. In addition, collet holder 206 may be arranged at a predetermined positive angle "c" or pitch (FIG. 3B) relative to the rotational axis "w" of grind wheel 204 to impart a tapered surface to any of the sides 1,2,3 of the needle end 12. In a preferred arrangement, angle "c" ranges from about 50° to about 70°, and, preferably, is about 60° relative to horizontal or transverse plane "t" which intersects the rotational axis "w" of grind wheel 204. FIG. 3B illustrates schematically this pitched arrangement of collet holder 206, collet 20 and needle end 14 relative to grind wheel 204. Collet holder 206 is further displaceable in the "x" direction toward grind wheel 204 of the relief grind mechanism.

Figure 3D:
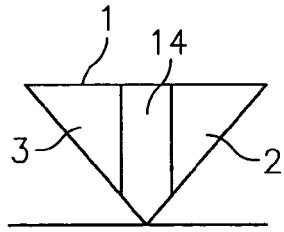
FIG. 3C is an axial schematic view illustrating the arrangement of the needle blank relative to the grind wheel of the relief grind mechanism.
Figure 3C:
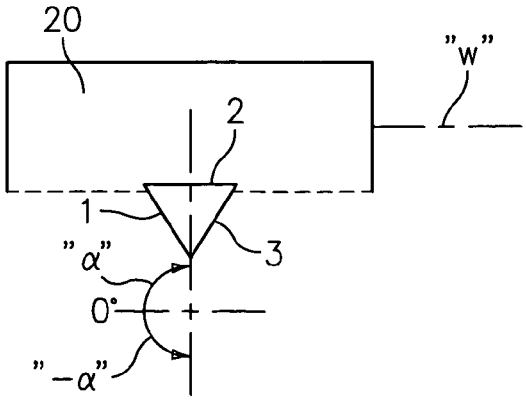

Referring now to FIG. 3C, collet 20 is initially arranged within collet holder 206 to present side 2 of needle end 12 to grind wheel 204. In FIG. 3C, the collet 20 and collet 206 are not shown for clarity purposes. As discussed above, indexing on collet 20 will facilitate obtaining the desired angular or rotational orientation within collet holder 206. In a first preferred position, collet 20 is placed at an angle "α" to position side 2 in parallel relation (e.g., horizontal) with the rotational axis "w" of grind wheel 204. For reference purposes, the zero (0) position of collet 20 corresponds to a horizontal or parallel arrangement of side 1 relative to the axis "w" of the grind wheel 204. The mechanism 200 is actuated and collet holder 206 is advanced along direction "x" such that grind wheel 204 contacts side 2 of needle end 12. The grind operation removes a desired amount of needle material from side 2. Thereafter, collet 20 is arranged at a predetermined angular orientation "−α" (e.g., −60°) within collet holder 206 to present side 3 of needle end 102 to grind wheel 204. Side 3 is also preferably arranged to be in parallel relation to the rotational axis "w" of grind wheel 202. The mechanism 200 is actuated to remove a predetermined amount of material from side 3. FIG. 3D depicts an axial view of the configuration of needle end 12 subsequent to the relief grind process. As shown, sides 2, 3 generally taper outwardly from end surface 14 towards the rear or main body of needle 10 to define a general pointed or tapered characteristic to needle end 12. It is appreciated that more or less material may be removed from needle end 12 and that end surface 14 of the needle end 10 may be more or less pointed in configuration. This tapered configuration of needle end 12 is achieved by virtue of the inclined orientation or pitch "c" of collet holder 206 relative to the transverse plane "p" of grind wheel 202.

With reference again to FIG. 1, the following step in the process is a press operation which involves forming a bayonet point on the needle end 12 (STEP 300). This operation incorporates a press having two lower dies formed to define a cavity for the press operation. With reference to FIG. 4A, the lower dies, i.e., left and right dies, 302, 304 of the press or bayonet form mechanism, each include an angle cut 306 in their upper surfaces which when joined together define a tapered, preferably, triangular-shaped recess 308 in cross-section. Recess 308 gradually decreases in cross-section from front surfaces 302*a*, 304*a* of dies 302, 304 to the middle die area where it terminates in point 308*p*. The press further includes upper punch 310 which moves to engage needle 10. Upper punch 310 includes radiused surface 312 having a slight radius of curvature "m". In one preferred embodiment, the radius of curvature "m" ranges from about 0.250 inches to about 0.500 inches. Preferably, the radius of curvature "m" is about 0.375 inches.

In operation, needle end 12 of needle blank 10 is placed within triangular-shaped recess 308 of left and right dies 302, 304 with side 1 of the needle end 12 directly opposing radiused surface 312. With reference to FIG. 4B, the press is actuated such that upper punch 310 advances to engage needle end 12 thereby swaging the needle end 12 to a general bayonet or triangular shape shown. Surface 1 assumes a slightly curved appearance through its swaging contact with radiused surface 312 of upper punch 310. Preferably, radiused surface 312 of upper punch 310 contacts the center of the needle end 12 to cause the needle material to more readily splay within recess 308 of the left and right dies 302, 304, i.e., by virtue of the contour of the radiused surface 312, the radiused surface 312 enters more deeply within the center of recess 308 and into the needle end 12, which causes the needle material to flow within the recess 308 in a uniform manner. The process, however, also creates an overflow flash "f" on each side of needle end 12 to thereby define the winged appearance shown in in FIG. 4B. The flash "f" extends radially outwardly from the edges of the needle end 12 generally following the contour of radiused surface 312 of upper punch 310. The flash material "f" has a thickness "t" adjacent to intersecting edges of sides 1, 2, 3 of about 0.002 inches. However, by virtue of the previous relief grind operation, the amount of flash "f" generated is substantially reduced as would normally be generated. As indicated hereinabove, this greatly facilitates the remaining operations of the preferred process by removing excess needle material which would otherwise require removal by the forming, trimming and etching operations.

Referring now to FIGS. 5A-5B, the next step in the process is a trim operation (STEP 400). The trim operation 400 incorporates two lower dies 402 which are identical to the bayonet forming dies 302, 304 of FIG. 4A. However, dies 402 also incorporate sharp raised protrusions 404 which extend along the perimeter of the recessed areas of each die and the flat remaining surfaces of the dies. The raised protrusion(s) 404 is preferably formed by an (electrode depositing machining EDM) process. The EDM process is coordinated to form a crease line or protrusion 404 adjacent the outer perimeter of the recess. Upon actuation of the press, the raised protrusion 404 forms a corresponding crease and/or perforation in the flash material adjacent location "p" (FIG. 5B) to trim the flash along the protrusions 404. The crease lines eventually become peripheral edges which serve as cutting edges in needle end 12. The thickness "t" adjacent each crease line is substantially reduced relative to corresponding thickness after the press operation 300, and may only be about 0.0005 inches thick. As appreciated, excess flash material "f" generated during the press operation 300 may still be present.

Referring again to FIG. 1, the next step in the process is a second grind operation (step 500). The second grind involves lightly grinding the area (e.g., line) of intersection of sides 2, 3 of the needle end 12 to reduce some excess flash material which may be adjacent this area and to also form a second point on needle end 12. The second grind operation may be performed with relief grind mechanism 202 of the relief grind operation 200 discussed hereinabove. In particular, needle blank 10 is arranged within collet holder 206 to present the area or edge connecting sides 2, 3 of needle end 14 to grind wheel 204. The grind mechanism 202 is actuated to grind a minimal amount of needle material from the edge.

FIG. 6 depicts in side plan view the configuration of needle end 12 subsequent to the second grind operation 500. This light grind step also forms a second needle point 18 on the needle end 12. The second needle point 18 is displaced from the first or distalmost needle point 16 which is created during the press operation 300. Second needle point 18 eventually defines secondary cutting edges extending from the second needle point 18 to main body 22 of needle blank 10. The grind surface 24 (i.e., the surface interconnecting the two points 16, 18) is at a minimal angle "j" preferably about 3° relative to the axis "z" of needle 10. Preferably, the removed material is only about a few tenths of a thousand of an inch.

Referring again to FIG. 1, the next step in the process is a flat process operation 600. The flat press operation 600 includes a gear-activated flat press. The press includes a box die set 602 which is best depicted in FIG. 7A. The box die is a two component die. One of the die components (e.g., the upper) 604 is movable while the second die component (e.g. the lower) 606 is stationary. The upper die 604 has a flat pressing surface 604*a*. The lower die 606 includes a rectangular recess 606*a* having lower pressing surface 608. Lower pressing surface 608 is arranged at a slight taper or angle to define an angulated punch. The angulated surface tapers upwardly from the front surface of the die set 602 to the rear surface. A preferred angle of taper ranges from about 1° to about 3°, and is preferably about 2°. This arrangement causes a greater or heavier swaging effect adjacent needle end 12 and a lighter swaging effect toward the back end of the needle 10. Accordingly, the needle material adjacent the needle end 12 splays outwardly to cause a portion of the needle end 12 to be wider than the remaining body 22 of needle blank 10. In this manner, the cutting edges 4, 5 at the intersections of sides 1, 2 and sides 1, 3 respectively are wider than main body 22 of needle blank 10 and taper back toward the body 22 to define a general spatula-head configuration.

In operation, needle blank 10 is placed within rectangular recess 606*a* with side 1 contacting lower surface 608 of lower die 606. The press is activated. The opposing surfaces of the needle 10 are then pressed whereby the needle material flows to be captured within rectangular recess 606*a*. Rectangular recess 606*a* thereby provides a uniform collective pool for the needle 100. Due to the inclined orientation of lower pressing surface 608, needle end 12 toward needle point 16 is pressed to a greater extent than the remaining portion or main body 22 of needle 10. The result of this feature is the formation of a spatula head on the needle end as depicted in FIG. 7B. The spatula head is characterized by having outer cutting edges 4, 5 defined along the respective lines of intersections of surfaces 1, 2, and surfaces 1, 3, which extend beyond the normal periphery of the needle 10 or beyond the edges of the needle body 22. The main body 22 of needle 10 assumes the rectangular configuration of rectangular recess 606*a*. FIG. 7C illustrates the cross section of the rectangular configuration of main body 22 of needle 10 after the flat press operation 600. Preferably, the cross-sectional dimension or needle width "w1" across one surface of the needle is less than the width "w2" across the other surface of the needle. Other configurations are also envisioned.

Thus, the aforementioned operations of the preferred process produce a needle having a spatula head configuration as depicted in the views of FIG. 5B (with the flash "f" material removed), FIG. 6, FIG. 7B and FIG. 7C.

It is envisioned that the aforementioned operations may be adapted to form other needle configurations besides the bayonet or spatula configuration disclosed. These alternate designs may be achieved by appropriate alternate design to the bayonet point form press and/or the trimming/crease forming dies.

The next operation is to curve the needle. This step 700 may be formed by any conventional means. In one embodiment, a curving mechanism is utilized to curve the needle body preferably along side 1 of the needle end 12. One suitable curving mechanism is disclosed in commonly assigned U.S. Pat. No. 5,626,043 to Bogart, the contents of which are incorporated by reference. The curving step 700 is optional.

It is envisioned that each of the above processing steps may be performed at one work station, i.e., that each work station or needle manufacturing apparatus may be adapted to perform each of the steps (including coining, grinding and pressing) required to manufacture a single needle in accordance with the preferred process. The parameters of manufacture may be programmed into the work station to control each operation based on needle type, size, etc. Computer programming, software etc., in conjunction with associated computer means, may be incorporated to coordinate the operation of the work station.

With reference again to FIG. 1, it is also contemplated that a heat treatment operation may be employed to treat the surgical needle to enhance the strength of the needle and its surgical cutting characteristics. The heat treatment operation 800 incorporates a conventional heat treatment oven. The needles are heated in the oven at a sufficient temperature for a sufficient period of time to effectively treat the needle blank(s). The temperature ranges and heating period are in conformance with the material of fabrication of the needle blank, and may be readily determined by one skilled in the art.

The next step in the process is a needle etching process 900. The needle etching process incorporates the step of submerging the surgical needle in an acid bath. The first stage of the etching or acid bath process is a high energy step 1000 where a relatively high amperage current is introduced into the bath of approximately 5-6 amps for about 20-40 seconds, preferably, 30 seconds at 12V-DC. The high energy phase aggressively moves excess flash material from the needle. The second phase in this process is a low energy step 1100 and includes directing relatively low amperage current of approximately 1 amp into the acid bath for about five minutes. This phase produces a matte-like finish on the needle. The needle may then be coated with a suitable coating, e.g. a silicon coating, PTFE coating or Teflon®.

It will be understood that various modifications may be made to the embodiments disclosed herein. Therefore, the above description should not be constructed as limiting, but merely as exemplifications of preferred embodiments. Those skilled in the art will envision other modification within the scope and spirit of the claims appended hereto.

What is claimed is:

1. A process for manufacturing a surgical needle, comprising the steps of:

providing a surgical needle blank, the needle blank comprising a biocompatible material;

coining the needle blank to define a needle end having first, second and third sides;

removing needle material from the needle end;

providing a die mechanism having a die arrangement with a die concavity therein and a die punch positioned in opposition to the die concavity, the die punch having a radiused surface;

positioning the needle end within the die concavity with the first side of the needle end in opposed relation to the die punch;

pressing the needle end by activating the die mechanism whereby the radiused surface of the die punch imparts an arcuate surface on the first side of the needle end; and forming cutting edges adjacent areas of intersection between the first, second and third sides to define a plurality of cutting edges on the needle end.

2. The process according to claim 1 wherein the step of removing the needle material includes grinding at least the second side of the needle end to remove material adjacent the second side of the needle end.

3. The process according to claim 2 wherein the step of removing the needle material includes grinding the third side of the needle end to remove material adjacent the third side of the needle end.

4. The process according to claim 1, the die concavity defines a tapered characteristic whereby the cross-sectional area occupied by the concavity decreases from one end of the concavity to the other end of the concavity and wherein the step of pressing imparts a tapered configuration to the needle end.

5. The process according to claim 4 wherein the die concavity of the die mechanism defines a general triangular configuration having first and second pressing surfaces and wherein the step of pressing includes positioning the needle blank within the concavity of the die mechanism to impart a generally tapered triangular-shaped cross-section to the needle end.

6. The process according to claim 1 wherein during the step of pressing, excess needle flash material is created adjacent the areas of intersection of the first and second sides, and the first and third sides of the needle end.

7. The process according to claim 6 including the step of trimming the flash material from the areas of intersection.

8. The process according to claim 7 wherein the step of trimming includes forming a crease line along each of the areas of intersection of the first and second sides, and the first and third sides of the needle end, the crease lines adapted to provide at least two cutting edges.

9. The process according to claim 8 including the step of etching the needle end to further remove flash material and sharpen the cutting edges.

10. The process according to claim 9 wherein the step of etching includes introducing a first current into the acid bath for a first determining period of time and introducing a second current into the acid bath for a second predetermined period of time.

11. The process according to claim 8 including the step of flat pressing the needle blank subsequent to the step of pressing the needle end.

12. The process according to claim 11 wherein the flat press includes at least one die, the at least one die defining a die cavity having a pressing surface, the pressing surface inclined relative to an axis of the at least one die whereby, during the step of pressing, the pressing surface impacts the needle end to cause needle material to flow such that at least portions of the at least two cutting edges extend beyond a perimeter of the body of the needle blank.

13. The process according to claim 8 including the step of heat treating the needle blank.

14. The process according to claim 5 wherein the first and second pressing surfaces of the die concavity are substantially planar and wherein the step of pressing includes imparting planar surfaces on the second and third sides of the needle end.

15. The process according to claim 8 wherein the step of trimming includes providing a trim die mechanism defining a die recess and having opposed raised protrusions adjacent the die recess and including the step of positioning the needle end within the die recess and pressing the needle end whereby the raised protrusions form the crease lines along respective areas of intersection.

16. A process for manufacturing a surgical needle, comprising the steps of:

providing a surgical needle blank, the needle blank comprising a biocompatible material;

coining the needle blank to define a coined needle end having first, second and third sides;

removing needle material from the coined needle end;

positioning the coined needle end within a die arrangement of a die mechanism and pressing the first side of the coined needle end with a die punch of the die mechanism, the die punch having a radiused surface to impart an arcuate surface on the first side of the needle end and to produce intersecting surface portions between the first, second and third sides of the coined needle end; and forming cutting edges adjacent areas of intersection of the surface portions.

17. The process according to claim 16 wherein the step of removing includes grinding the coined needle end.

18. A process for manufacturing a surgical needle comprising the steps of:

providing a needle blank;

coining the needle blank to define a needle end having first, second and third sides;

pressing the first, second and third sides of the needle end within a press die mechanism to impart a generally tapered triangular cross-section to the needle end;

positioning the needle end within a trim die mechanism having a trim die cavity and opposed raised protrusions adjacent each side of the trim die cavity;

activating the trim die mechanism to impart crease lines within needle overflow material adjacent an area of between the first and the second sides of the needle end and adjacent an area between the first and third sides of the needle end; and forming cutting edges along the crease lines of the needle end.

19. The process according to claim 18 wherein the step of forming cutting edges includes etching the needle end to facilitate removal of the needle overflow material adjacent the crease lines.

* * * * *